US011946182B2

(12) United States Patent
Marcangelo

(10) Patent No.: US 11,946,182 B2
(45) Date of Patent: Apr. 2, 2024

(54) SEWING MACHINE WITH ADJUSTABLE STEPPING HEIGHT AND RELATED METHODS

(71) Applicant: Steven Marcangelo, Edgewater, FL (US)

(72) Inventor: Steven Marcangelo, Edgewater, FL (US)

( * ) Notice: Subject to any disclaimer, the term of this patent is extended or adjusted under 35 U.S.C. 154(b) by 78 days.

(21) Appl. No.: 17/668,029

(22) Filed: Feb. 9, 2022

(65) Prior Publication Data

US 2023/0250569 A1 Aug. 10, 2023

(51) Int. Cl.
*D05B 29/02* (2006.01)
*D05B 27/06* (2006.01)
*D05B 55/14* (2006.01)

(52) U.S. Cl.
CPC ..... *D05B 29/02* (2013.01); *D05B 27/06* (2013.01); *D05B 55/14* (2013.01)

(58) Field of Classification Search
CPC ..... D05B 27/02; D05B 27/04; D05B 27/06; D05B 27/24; D05B 29/02
See application file for complete search history.

(56) References Cited

U.S. PATENT DOCUMENTS 989,538 A * 4/1911 Ronkte ..... D05B 27/04 112/310
1,220,726 A * 3/1917 Chalman ..... D05B 27/04 112/311
2,119,316 A * 5/1938 Clayton ..... D05B 27/04 112/320
4,422,398 A * 12/1983 Dusch ..... D05B 27/04 112/320
4,449,464 A 5/1984 Porter
4,589,364 A * 5/1986 Yamamoto ..... D05B 27/04 112/311
4,759,304 A * 7/1988 Nava ..... D05B 27/04 112/311
5,138,962 A * 8/1992 Klundt ..... D05B 29/00 112/311

(Continued)

FOREIGN PATENT DOCUMENTS

EP 2660378 A1 * 11/2013 ..... D05B 27/24
WO WO-8901067 A1 * 2/1989 ..... D05B 29/00
WO 2020231673 A1 11/2020

OTHER PUBLICATIONS

Pegasus Sewing Machine Mfg. Co., Ltd, EXT Series Technical Manual, Cat. No. 9725, Oct. 1996, 35 pgs.

*Primary Examiner* — Patrick J. Lynch
(74) *Attorney, Agent, or Firm* — ROONEY IP, LLC

(57) ABSTRACT

A kit for adding or replacing an automated upper walking foot stepping height adjustment to a sewing machine, the kit includes a mounting assembly including an actuator bracket, an actuator coupled to the actuator bracket, a drive assembly, and a needle drive assembly. The actuator includes an actuator shaft that extends and retracts. The drive assembly includes a drive shaft, a drive arm coupled to the drive shaft and the actuator shaft, and a guide coupled to the drive shaft. The needle drive assembly includes a variable drive crank coupled to the guide and configured to couple to a needle drive shaft of a sewing machine. Selectively extending and retracting the actuator shaft selectively adjusts a stepping height of an upper walking foot.

25 Claims, 11 Drawing Sheets

(56) References Cited

U.S. PATENT DOCUMENTS

| | | | | |
|---|---|---|---|---|
| 5,174,230 | A * | 12/1992 | Noguchi | D05B 27/04 112/311 |
| 7,360,497 | B2 | 4/2008 | Marcangelo et al. | |
| 10,961,645 | B2 | 3/2021 | Marcangelo | |
| 2007/0163477 | A1* | 7/2007 | Nagata | D05B 29/02 112/237 |
| 2019/0352823 | A1* | 11/2019 | Tachikawa | D05B 19/10 |
| 2020/0354871 | A1* | 11/2020 | Marcangelo | D05B 27/02 |

* cited by examiner

SEWING MACHINE WITH ADJUSTABLE STEPPING HEIGHT AND RELATED METHODS

TECHNICAL FIELD

Embodiments relate generally to sewing machines, and more particularly to industrial sewing machines having the capability of sewing relatively thinner materials and relatively thicker materials, and related methods.

BACKGROUND

Industrial sewing machines are often used for sewing together materials of different combined thicknesses. When material is being sewn on a sewing machine, the material rests on a throat plate or needle plate. A presser foot presses on the top of the material and an upper walking foot or top feed dog helps to feed the material as the material is sewn by a needle or needles. The thickness of the material which can be sewn by the machine is dictated by the clearance between the throat plate below the material and the needle, presser foot, and upper walking foot above the material. The throat of the machine is the space between the throat plate and the needle, presser foot, and upper walking foot. Sewing machines used for sewing both thinner and thicker materials will generally have the ability to adjust the throat or vertical clearance of the presser foot and upper walking foot for the material to fit through the throat of the machine.

Some industrial sewing machines capable of sewing thinner and thicker materials utilize an upper walking foot and a lower feed dog (sometimes referred to as "top and bottom feed") and are configured to impart out-of-phase reciprocatory movement of the presser foot and upper walking foot. In these types of sewing machines, the upper walking foot travels in a more or less elliptical motion during sewing, and thus has a horizontal motion component (stepping length or feed length) and a vertical motion component (stepping height). Some industrial sewing machines capable of sewing thinner and thicker materials include adjustment mechanisms, multiple drive shafts, and linkage assemblies that add to the complexity of the sewing machine. Proper adjustment of the stepping height of the upper walking foot is typically a manual and/or time-consuming process.

Accordingly, and despite the various advances already made in this field, there is a need for further improvements related to providing sewing machines with an ability to readily adjust the stepping height to more quickly and easily configure the machine for sewing thicker and thinner materials on demand.

SUMMARY

Generally, a kit for adding or replacing an automated upper walking foot stepping height adjustment to a sewing machine is described and comprises a mounting assembly including an actuator bracket, an actuator coupled to the actuator bracket, a drive assembly, and a needle drive assembly. The actuator includes an actuator shaft that extends and retracts. The drive assembly includes a drive shaft, a drive arm coupled to the drive shaft and the actuator shaft, and a guide coupled to the drive shaft. The needle drive assembly includes a variable drive crank coupled to the guide and configured to couple to a needle drive shaft of a sewing machine. Selectively extending and retracting the actuator shaft selectively adjusts a stepping height of an upper walking foot.

In some embodiments, selectively extending and retracting the actuator shaft sets an uppermost travel limit of a presser foot. The needle drive assembly may include a needle drive shaft coupled to the variable drive crank. The needle drive assembly may include a needle drive lever coupled to the needle drive shaft and configured to drive a needle assembly of a sewing machine. The needle drive assembly may include a needle drive crank coupled to the needle drive shaft and configured to couple to a crank arm of a sewing machine, and the crank arm drives the needle drive assembly. The kit may include a pin, and the variable drive crank may include an elongated slot and the pin moves within the slot, and selectively extending and retracting the actuator shaft adjusts a position of the pin along a length of the slot. The kit may include a cover configured to replace an existing cover of the sewing machine and the actuator bracket is coupled to the cover. The kit may include a control coupled to the actuator, and a user selectively extends and retracts the actuator shaft using the control.

Generally, a sewing machine with an automated upper walking foot stepping height adjustment is described and comprises a mounting assembly including an actuator bracket, an actuator coupled to the actuator bracket, a drive assembly, a needle drive assembly, an upper walking foot, and a needle assembly. The actuator includes an actuator shaft that extends and retracts. The drive assembly includes a drive shaft, a drive arm coupled to the drive shaft and coupled to the actuator shaft, and a guide coupled to the drive shaft. The needle drive assembly includes a needle drive shaft, a needle drive lever coupled to the needle drive shaft, a variable drive crank coupled to the needle drive shaft and the guide, and a needle drive crank coupled to the needle drive shaft. The upper walking foot is coupled to the variable drive crank. The needle assembly is coupled to the needle drive crank. Selectively extending and retracting the actuator shaft adjusts a stepping height of the upper walking foot.

In some embodiments, the sewing machine may include a presser foot coupled to the variable drive crank, and selectively extending and retracting the actuator shaft sets an uppermost travel limit of the presser foot. The sewing machine may include a control coupled to the actuator, and a user selectively extends and retracts the actuator shaft using the control. The sewing machine may include a pin, and the variable drive crank may include an elongated slot and the pin moves within the slot, and selectively extending and retracting the actuator shaft adjusts a position of the pin along a length of the slot.

A method of adjusting a stepping height of an upper walking foot of a sewing machine is described and includes selectively extending and retracting an actuator shaft, and actuating a guide and variable drive crank to adjust the stepping height of the upper walking foot. The method may include actuating the guide and variable drive crank to adjust the stepping height of a presser foot.

A method of adding or replacing an automated upper walking foot stepping height adjustment to a sewing machine is described and includes installing a mounting assembly including an actuator bracket to a sewing machine, coupling an actuator with an actuator shaft that extends and retracts to the actuator bracket, coupling a drive arm to the actuator shaft, coupling the drive arm to a drive shaft, coupling a guide to the drive shaft, and coupling a variable drive crank to the guide and a needle drive shaft of the sewing machine.

In some embodiments, the method of adding or replacing an automated upper walking foot stepping height adjustment to a sewing machine may include providing a needle drive shaft and coupling the variable drive crank to the needle drive shaft. The variable drive crank may include an elongated slot, and the method may include coupling a pin to the guide and the pin moves within the slot of the variable drive crank. The method may include coupling a presser foot to the variable drive crank. The method may include coupling a stepping height control to the actuator.

A method of manufacturing a sewing machine with an automated upper walking foot stepping height adjustment is described and includes installing a mounting assembly including an actuator bracket to a sewing machine, coupling an actuator with an actuator shaft that extends and retracts to the actuator bracket, coupling a drive arm to the actuator shaft, coupling the drive arm to a drive shaft, coupling a guide to the drive shaft, coupling a variable drive crank to the guide and a needle drive shaft, coupling a needle drive lever to the needle drive shaft, coupling a needle assembly to the needle drive lever, and coupling an upper walking foot to the variable drive crank.

In some embodiments, the method of manufacturing a sewing machine with an automated upper walking foot stepping height adjustment the variable drive crank includes an elongated slot and the method includes coupling a pin to the guide, and the pin moves within the slot of the variable drive crank. The method may include coupling a presser foot to the variable drive crank. The method may include coupling a stepping height control to the actuator.

Additional aspects and advantages of the invention will become more apparent upon further review of the detailed description of the illustrative embodiments taken in conjunction with the accompanying drawings.

DETAILED DESCRIPTION

Figure 1:
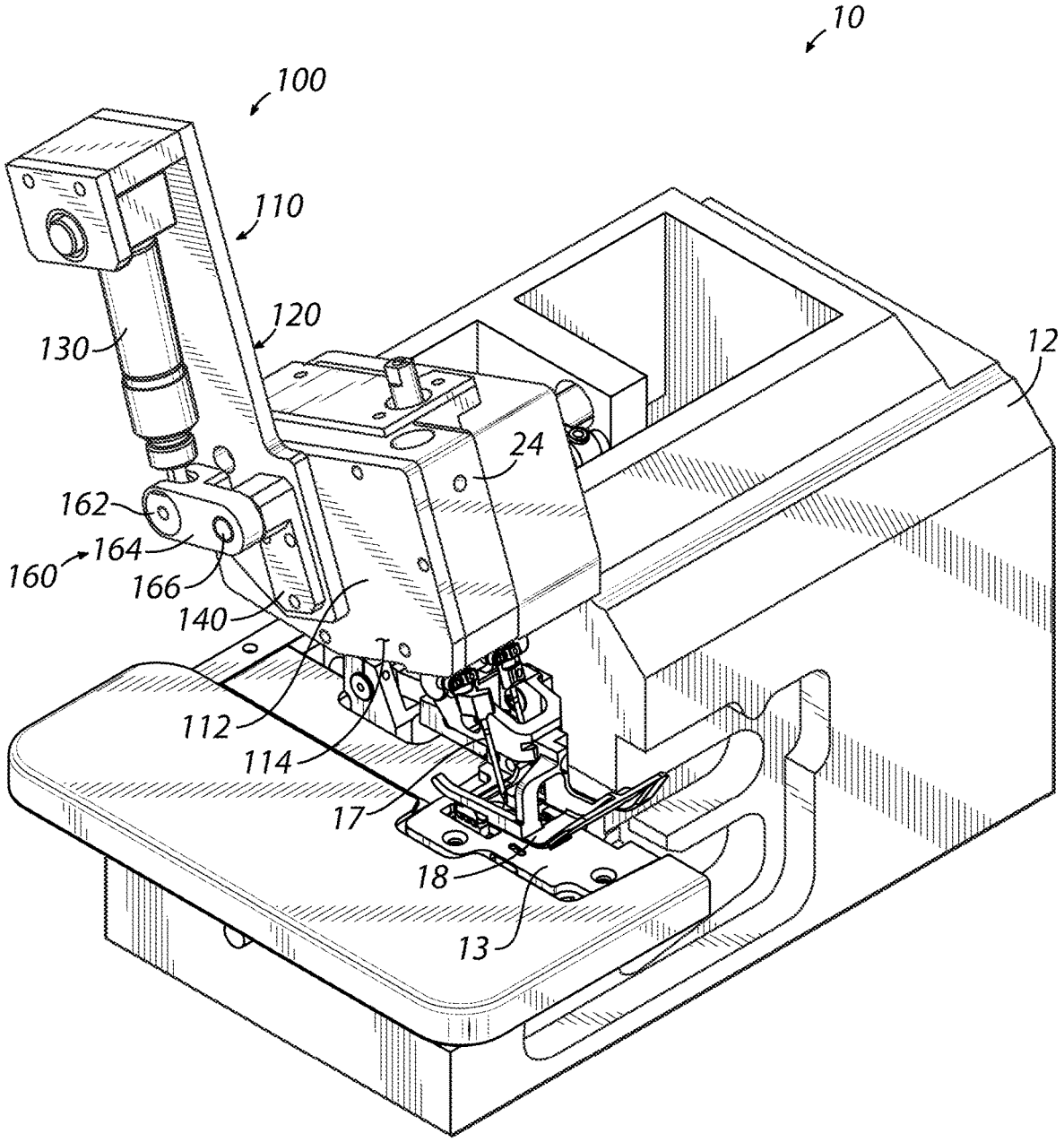
FIG. 1 is a front, top, left perspective view of an illustrative sewing machine.
Figure 9:
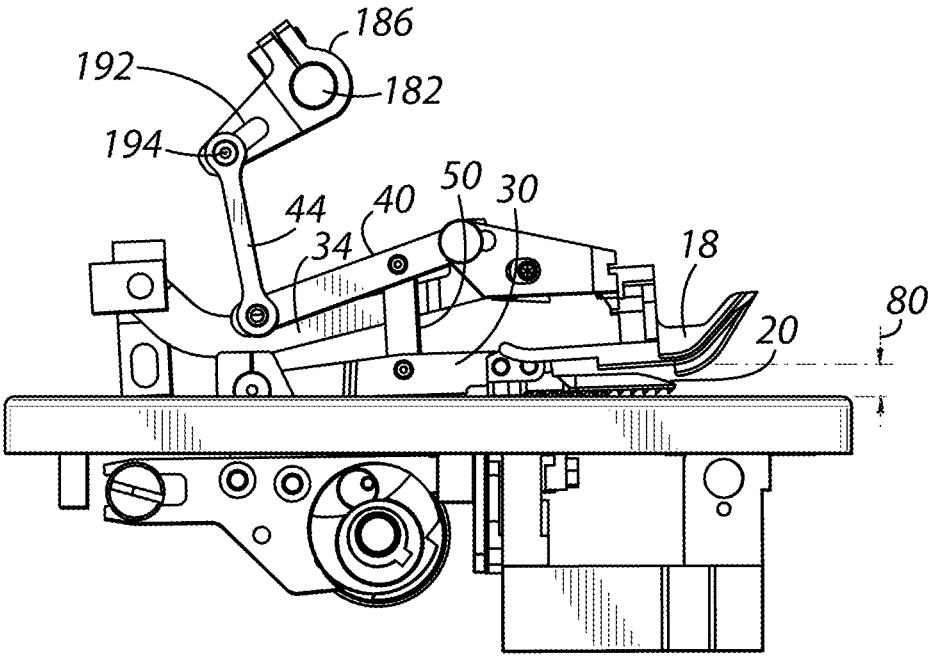
FIG. 9 is a detailed left side view of a portion of the sewing machine of FIG. 1 with the stepping height adjustment mechanism set for a high stepping height.

Referring to FIG. 1, an illustrative sewing machine 10 includes, a machine base and/or frame 12, a throat plate 13, a needle assembly 16 (see FIG. 4), a presser foot 18, and an upper walking foot 20 (see FIG. 9). When material is being sewn on the sewing machine 10, the material rests on the throat plate 13. The presser foot 18 presses on the top of the material and the upper walking foot 20 helps to feed the material as the material is sewn by a needle or needles 17. The thickness of the material which can be sewn by the machine 10 is limited by the clearance between the throat plate 13 below the material and the needle 17, presser foot 18, and upper walking foot 20 above the material. The throat of the machine is the space between the throat plate 13 and the needle 16, presser foot 18, and upper walking foot 20. Sewing machines, such as flanging machines, used for sewing both thinner and thicker materials, such as non-woven materials, will generally have the ability to adjust the throat or vertical clearance of the presser foot 18 and upper walking foot 20 in order for the material to fit through the throat of the machine.

Generally, a variable drive assembly 100 is described herein and includes the components needed to add an automated upper walking foot stepping height adjustment to a sewing machine 10. In some embodiments, the variable drive assembly 100 may include the components needed to replace an upper walking foot stepping height adjustment of a sewing machine 10. The variable drive assembly 100 may also allow for automated adjustment of the uppermost travel limit of the presser foot 18. Allowing for adjustment of the uppermost travel limit of the presser foot 18 may minimize presser foot spring deflection thereby minimizing the likelihood of the presser foot floating on the material and thereby improve the performance of the sewing machine 10, for example.

In some embodiments, the variable drive assembly 100 can be installed without additional modifications to the sewing machine 10. The variable drive assembly 100 may be configured such that the modifications to the sewing machine can be completed with hand tools. The variable drive assembly 100 may be configured such that installation can be completed by someone of ordinary technical skill instead of requiring precision machine shop modifications and factory trained technicians to complete the installation, for example. The variable drive assembly 100 may be part of a kit to convert a sewing machine 10 from a manual upper walking foot stepping height adjustment to an automated upper walking foot stepping height adjustment. In some embodiments, the variable drive assembly 100 described herein may be part of a complete sewing machine.

In this illustrative embodiment, the variable drive assembly 100 simplifies the design of the sewing machine 10 by reducing the number of shafts and/or linkages of the sewing machine 10. The variable drive assembly 100 allows for a single common drive shaft for driving the needle assembly 16, the presser foot 18, and the upper walking foot 20. By reducing the number of shafts and/or linkages of the sewing machine 10, the variable drive assembly 100 may improve the reliability and/or serviceability of the sewing machine 10.

Referring to FIGS. 2 through 5, in this illustrative embodiment, the variable drive assembly 100 includes a mounting assembly 110, an actuator 130, a drive assembly 160, and a needle drive assembly 180. The mounting assembly 110 includes a cover 112, an actuator bracket assembly 120, an outer block 140, and an inner block 142. The cover 112 has an outside surface 114 and an inside surface 116. The bracket assembly 120 includes a bracket 122, a horizontal spacer 124, and a vertical spacer 126. The actuator 130 has two mounting points 132 and a shaft 134. The shaft 134 extends and retracts. The bracket assembly 120 includes two bushings 128 for pivotably mounting the actuator 130 at the two mounting points 132. The bushings 128 may be constructed from a material requiring little or no lubrication, such as bronze for example. In some embodiments, the bushings 128 may be bearings, for example. In this illustrative embodiment, the actuator 130 is a pneumatic cylinder. In some embodiments, the actuator 130 may be a linear actuator, for example. In some embodiments, the actuator 130 may be a hydraulic cylinder, for example. In some embodiments, the actuator 130 may be a gearhead motor. In some embodiments, the actuator 130 may have a single mounting point.

In this illustrative embodiment, the outer block 140 is mounted to the bracket 122, the bracket 122 is mounted to the outside 114 of the cover 112, and the inner block 142 is mounted to the inside 116 of the cover 112. The cover 112 is mounted to a needle housing 24. The cover 112, as part of the variable drive assembly 100 describe herein, replaces a needle housing cover on an existing sewing machine. The outer block 140 and inner block 142 each include a drive shaft bearing 144. The inner block 142 also includes a needle drive shaft bearing 146. In this illustrative embodiment, the bearings 144, 146 are needle bearings. In some embodiments, the bearings 144, 146 may be ball bearings and/or sleeve bearings, for example.

The drive assembly 160 includes a pivot 162, a drive arm 164, a drive shaft 166, and a guide 168. The actuator shaft 134 is coupled to the pivot 162, the pivot 162 is pivotally connected to a first end 170 of the drive arm 164, and a second end 172 of the drive arm 164 is coupled to a first end 174 of the drive shaft 166. The drive shaft 166 passes through the outer block 140, bracket 112, cover 112, and inner block 142 and is rotatably supported by the bearings 144. The guide 168 is coupled to a second end 176 of the drive shaft 166. The guide 168 includes a recessed groove 178.

Figure 13:
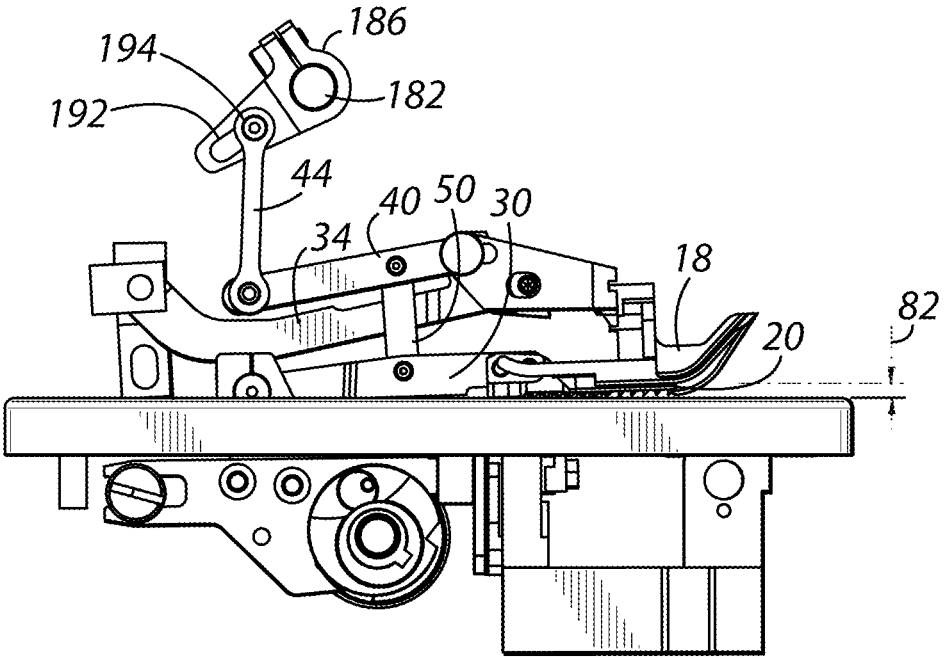
FIG. 13 is a detailed left side view of a portion of the sewing machine of FIG. 1 with the stepping height adjustment mechanism set for a low stepping height.

The needle drive assembly 180 includes a needle drive shaft 182, a needle drive lever 184, a variable drive crank 186, and a needle drive crank 188. The variable drive crank 186 includes a hole 190 for mounting the variable drive crank 186 onto the needle drive shaft 182 and a longitudinal slot 192 for a pin 194. The pin 194 includes a wear disc 196. As illustrated in FIGS. 9 and 13, the pin 194 is coupled to a link 44, the variable drive crank 186, and the guide 168. The wear disc 196 moves within the recessed groove 178 of the guide 168 and this movement determines the position of the pin 194 within the longitudinal slot 192 of the variable drive crank 186. The position of the pin 194 within the longitudinal slot 192 of the variable drive crank 186 determines the location of the upper end of link 44. The needle drive crank 188 includes a hole 190 for mounting the needle drive crank 188 onto the needle drive shaft 182 and a pair of holes 198 for connecting to a crank arm 60. The crank arm 60 is pivotally connected at its lower end to a crank shaft 14 and is pivotally connected at its upper end to needle drive crank 188 at 198. A first end 200 of the needle drive shaft 182 is rotatably supported by the needle drive shaft bearing 146. The variable drive crank 186 and the needle drive crank 188 are coupled to the needle drive shaft 182.

Figure 6:
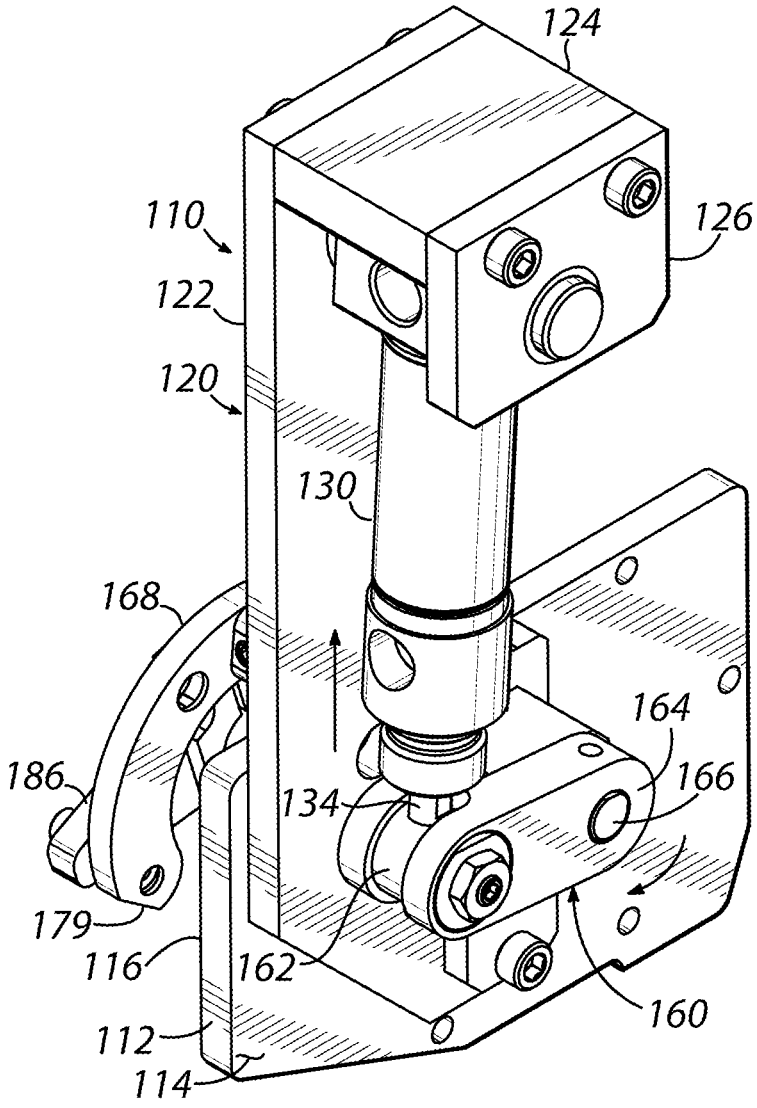
FIG. 6 is a detailed rear, top, left perspective view of an illustrative actuator of the stepping height adjustment mechanism illustrated in FIG. 5 set for a high stepping height.
Figure 8:
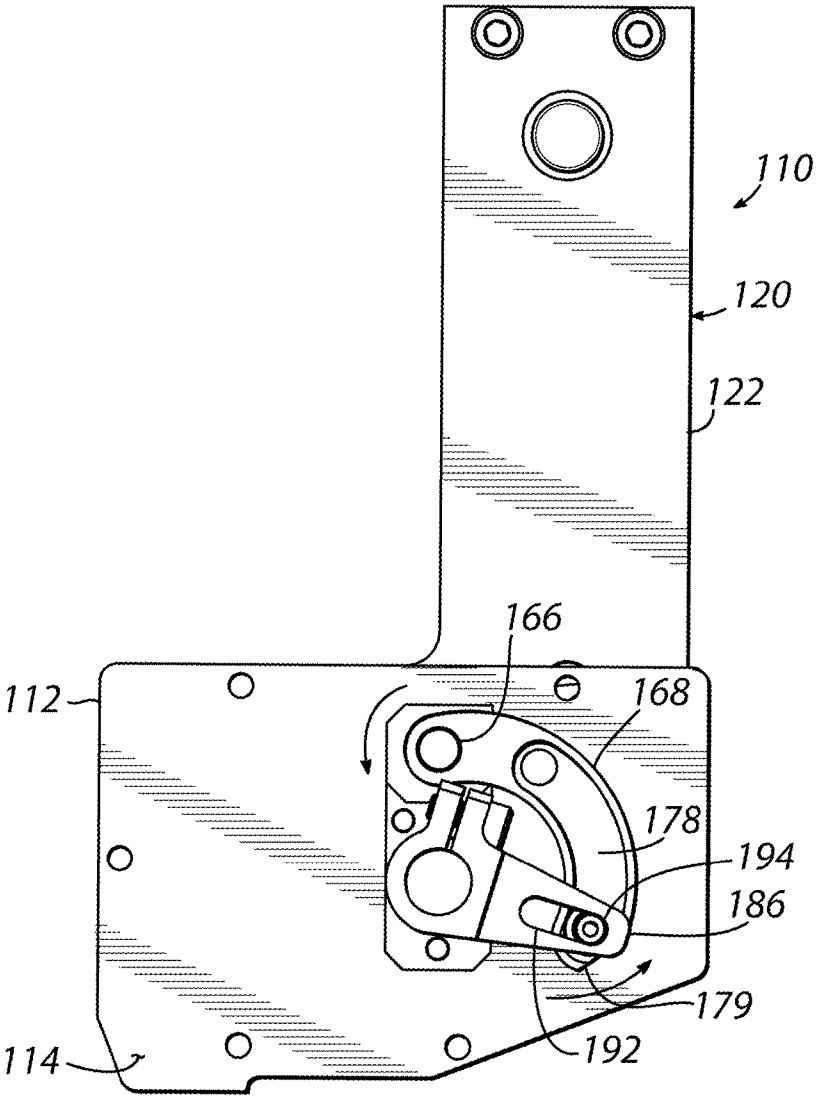
FIG. 8 is a detailed right view of a portion of the stepping height adjustment mechanism illustrated in FIG. 5 set for a high stepping height.
Figure 7:
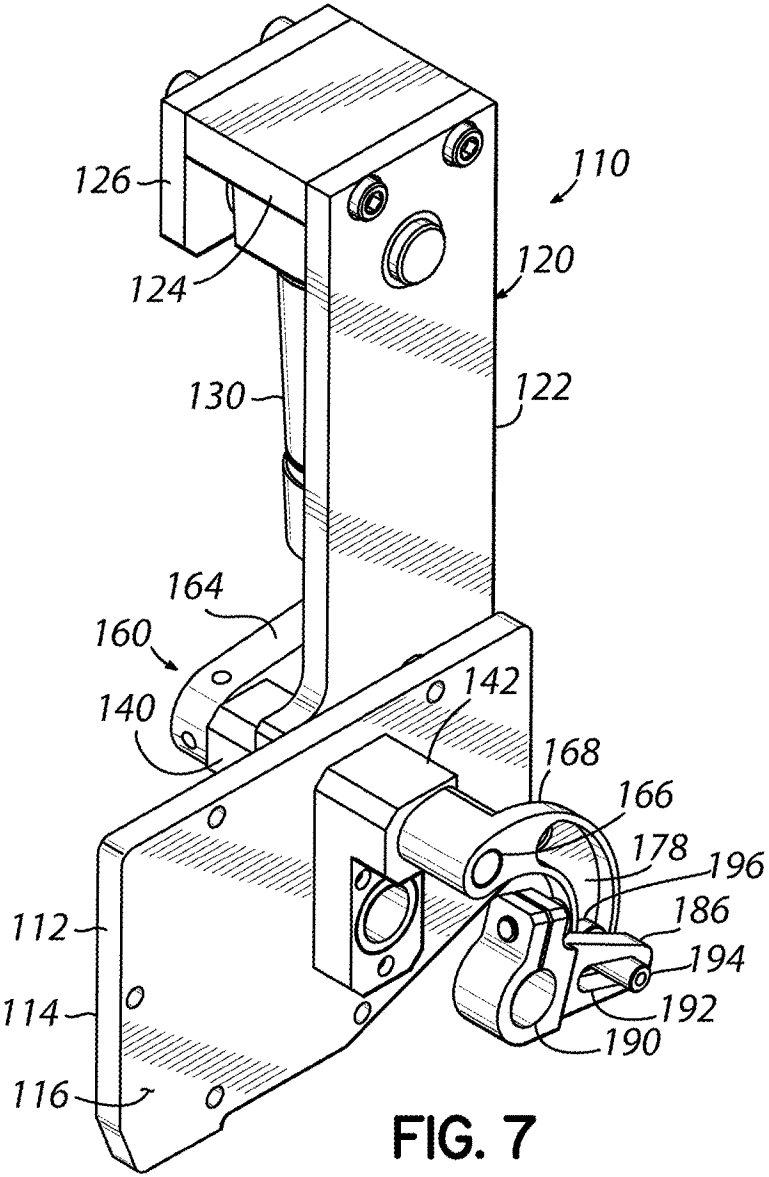
FIG. 7 is a detailed front, top, right perspective view of a portion of the stepping height adjustment mechanism illustrated in FIG. 5 set for a high stepping height.

Referring to FIGS. 6 through 8, in this illustrative embodiment, retracting the actuator shaft 134 moves the pivot 162 which rotates the drive arm 164 in a first direction about the axis of the drive shaft 166 and rotates the drive shaft 166 in a first direction which rotates the guide 168. The guide 168 includes a beveled portion 179, for clearance from other components or structures of the sewing machine 10, for example. When the guide 168 rotates, the wear disc 196 in the groove 178 moves the pin 194 in the slot 192 of the variable drive crank 186 depending on the position of the guide 168. When the actuator shaft 134 is in a first position, the guide 168 is in a first position. As also illustrated in FIG. 9, the groove 178 of the guide 168 maintains the pin 194 in a first position in the slot 192 of the variable drive crank 186. The upper walking foot 20 is supported at the front end of an arm 30. As used herein, the term front generally refers to the front of the sewing machine 10 where a user or operator would normally be positioned to operate and feed the material to be sewn into the throat of the sewing machine 10. The presser foot 18 is supported at the front end of an arm 34. A link 40 is pivotally connected at its front end to the presser foot 18 and is pivotally connected at its opposite rear end to a lower end of link 44. The walking foot arm 30 and link 40 are pivotally connected by a link 50. The linkage assembly including arm 30, arm 34, link 40, link 44, and link 50, is configured to cause out-of-phase reciprocatory movement of the presser foot 18 and the upper walking foot 20. As used herein, the terms linkage and linkage assembly may include an assemblage of multiple links having fixed and/or pivotal connections, as well as a single link or lever having fixed and/or pivotal connections.

When the actuator shaft 134 is in the retracted position, as shown in FIGS. 6 through 8, the pin 194 in the slot 192 of the variable drive crank 186 sets a high stepping height 80 of the upper walking foot 20 to accommodate thicker material, as shown in FIG. 9, for example. When the actuator shaft 134 is in the retracted position the position the pin 194 in the slot 192 of the variable drive crank 186 sets a high stepping height 80 of the presser foot 18 to accommodate thicker material, for example. In FIG. 9, the upper walking foot 20 is at its lower limit of travel, and the presser foot 18 is at its lower limit of travel (material stitching positions of these elements).

Figure 10:
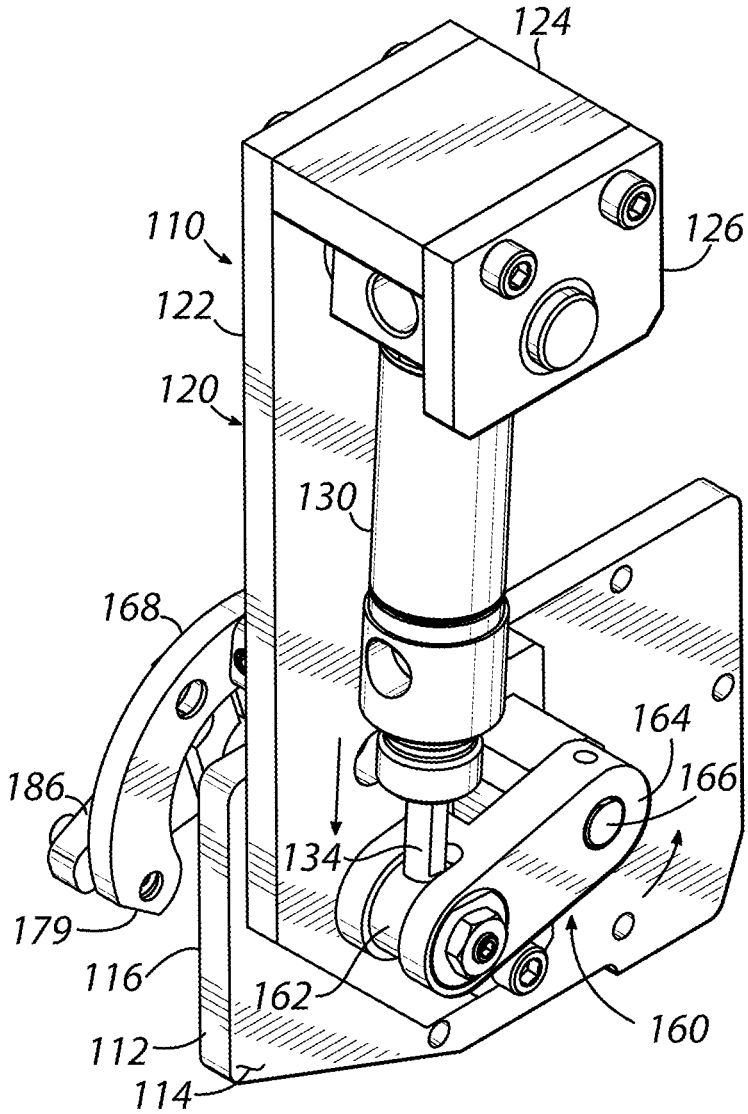
FIG. 10 is a detailed rear, top, left perspective view of an illustrative actuator of the stepping height adjustment mechanism illustrated in FIG. 5 set for a low stepping height.
Figure 12:
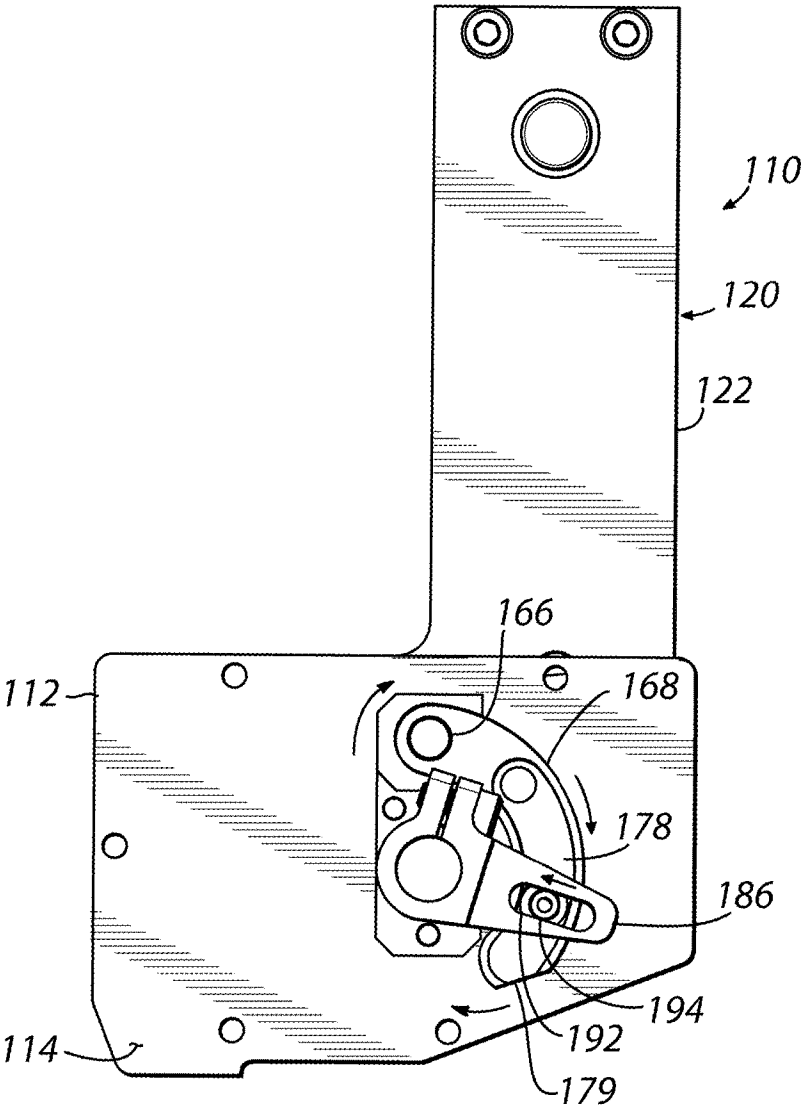
FIG. 12 is a detailed right view of a portion of the stepping height adjustment mechanism illustrated in FIG. 5 set for a low stepping height.
Figure 11:
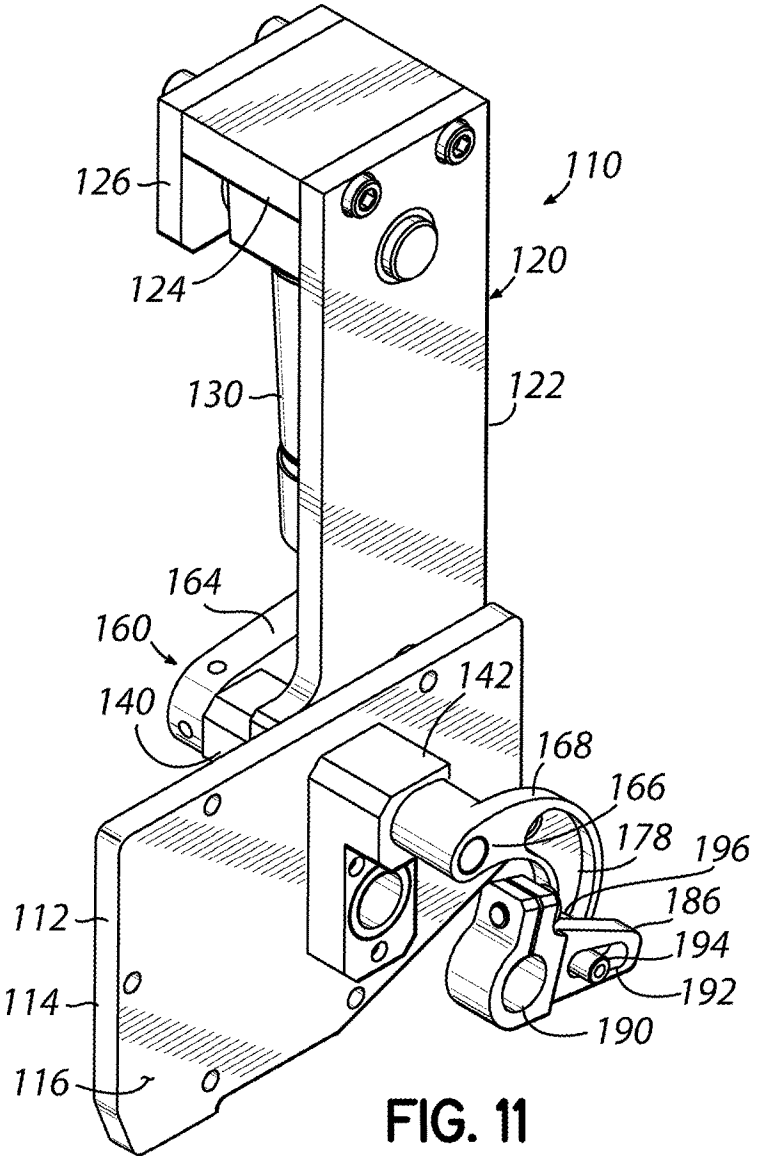
FIG. 11 is a detailed front, top, right perspective view of a portion of the stepping height adjustment mechanism illustrated in FIG. 5 set for a low stepping height.

Referring to FIGS. 10 through 12, in this illustrative embodiment, extending the actuator shaft 134 moves the pivot 162 which rotates the drive arm 164 in a second direction about the axis of the drive shaft 166 and rotates the drive shaft 166 in a second direction which rotates the guide 168. When the guide 168 rotates, the wear disc 196 in the groove 178 moves the pin 194 in the slot 192 of the variable drive crank 186 depending on the position of the guide 168. When the actuator 134 is in a second position, the guide 168 is in a second position. As also illustrated in FIG. 13, the groove 178 of the guide 168 maintains the pin 194 in a second position in the slot 192 in the variable drive crank 186. When the actuator shaft 134 is in the extended position the position the pin 194 in the slot 192 of the variable drive crank 186 sets a low stepping height 82 of the upper walking foot 20 to accommodate thinner material, for example. When the actuator shaft 134 is in the extended position the position the pin 194 in the slot 192 of the variable drive crank 186 sets a low stepping height 82 of the presser foot 18 to accommodate thinner material, for example. In FIG. 13, the stepping foot 20 is at its lower limit of travel, and the presser foot 18 is at its lower limit of travel (material stitching positions of these elements).

In this illustrative embodiment, the upper walking foot 20 has two stepping height positions, i.e. the low stepping height and the high stepping height, due to the two position operation of the actuator 130. A user selectively adjusts the stepping height. In some embodiments, the variable drive assembly 100 includes a stepping height control 136 allowing a user to selectively adjust the stepping height. In this illustrative embodiment, the stepping height control 136 is a toggle switch. In some embodiments, the stepping height control 136 is a selector switch, for example. In some embodiments, the variable drive assembly 100 includes a stepping height control mounting bracket 137. In some embodiments, alternate actuators allow for the stepping height of the upper walking foot 20 to be continuously or infinitely variable between the high stepping height (FIG. 9) and the low stepping height (FIG. 13).

Referring to FIGS. 2 through 4, and 9, generally, a stepping height of the upper walking foot 20 is adjusted by extending and retracting the actuator shaft 134 of the actuator 130 which pivots the drive arm 164 which is coupled to the actuator shaft 134 by the pivot 162. Pivoting the drive arm 164 rotates the drive shaft 166 coupled to the drive arm 164. Rotating the drive shaft 166 pivots the guide 168 coupled to the drive shaft 166. Pivoting the guide 168 pivots the variable drive crank 186 which is coupled to the guide 168 by the pin 194 and wear disc 196. Extending and retracting the actuator shaft 134 adjusts the stepping height of the upper walking foot 20. In this illustrative embodiment, extending and retracting the actuator shaft 134 also adjusts the stepping height of the presser foot 18.

Figure 2:
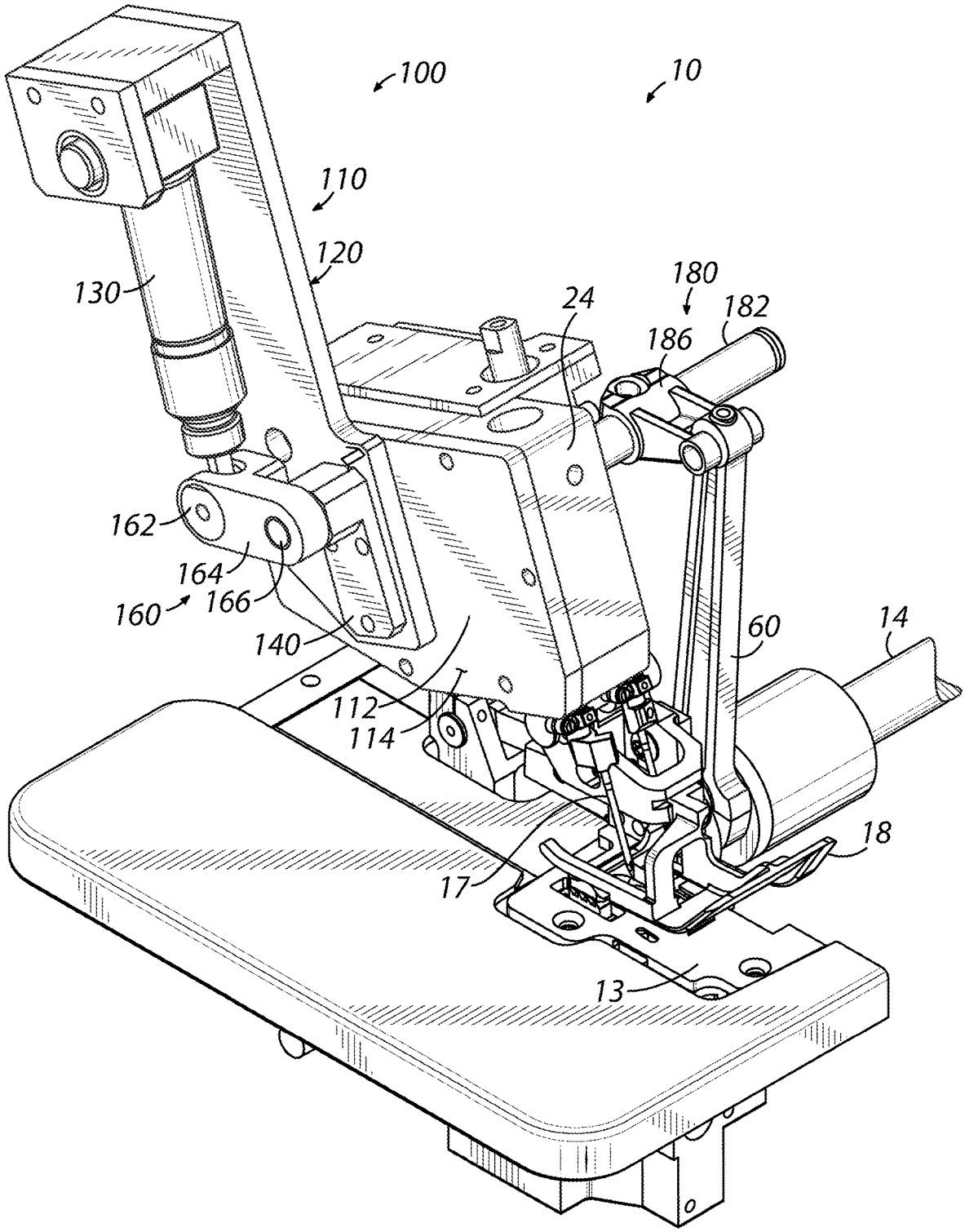
FIG. 2 is a detailed front, top, left perspective view of an illustrative sewing machine mechanism of the sewing machine illustrated in FIG. 1.
Figure 3:
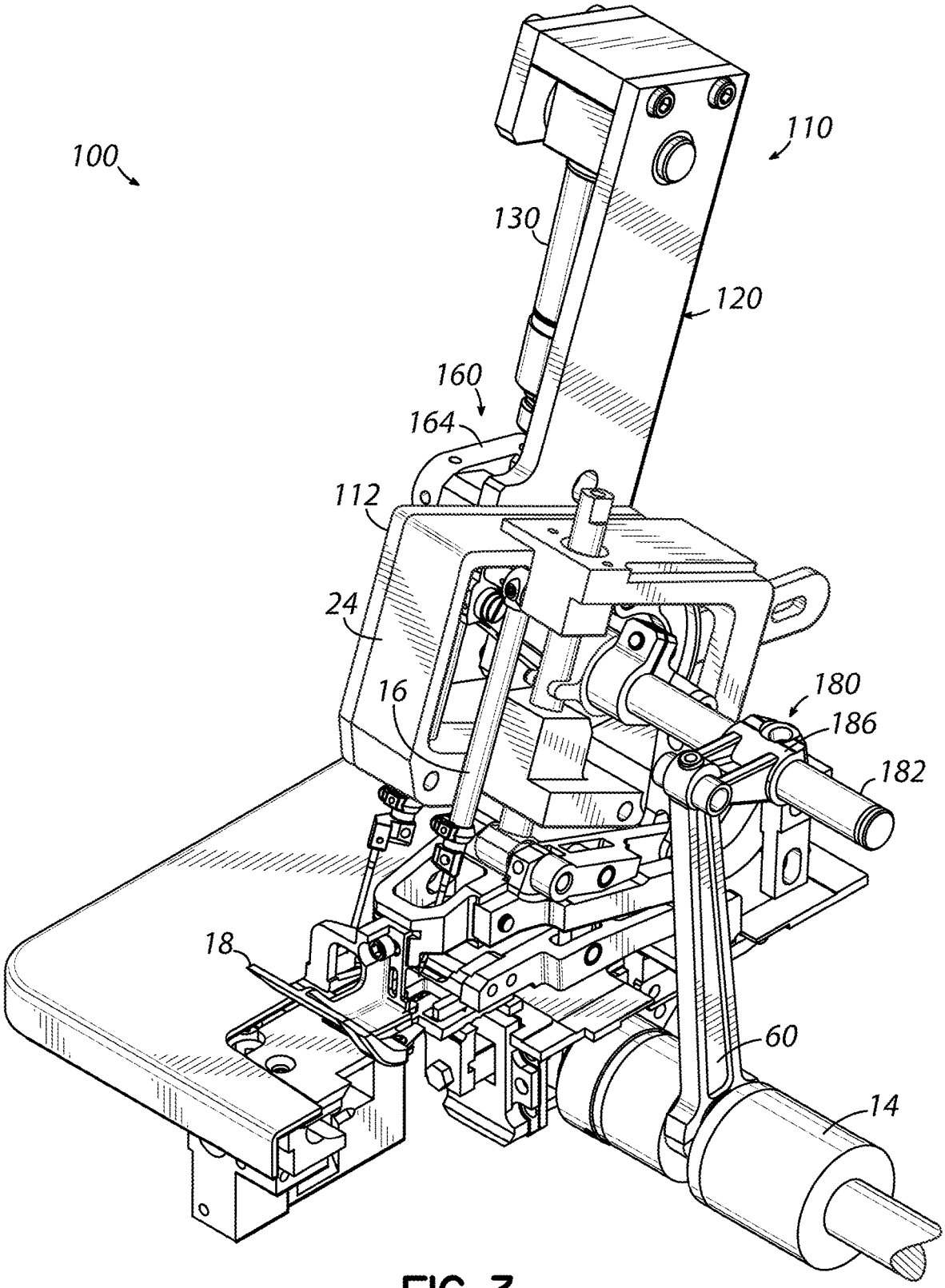
FIG. 3 is a detailed front, top, right perspective view of the sewing machine mechanism of FIG. 2.
Figure 4:
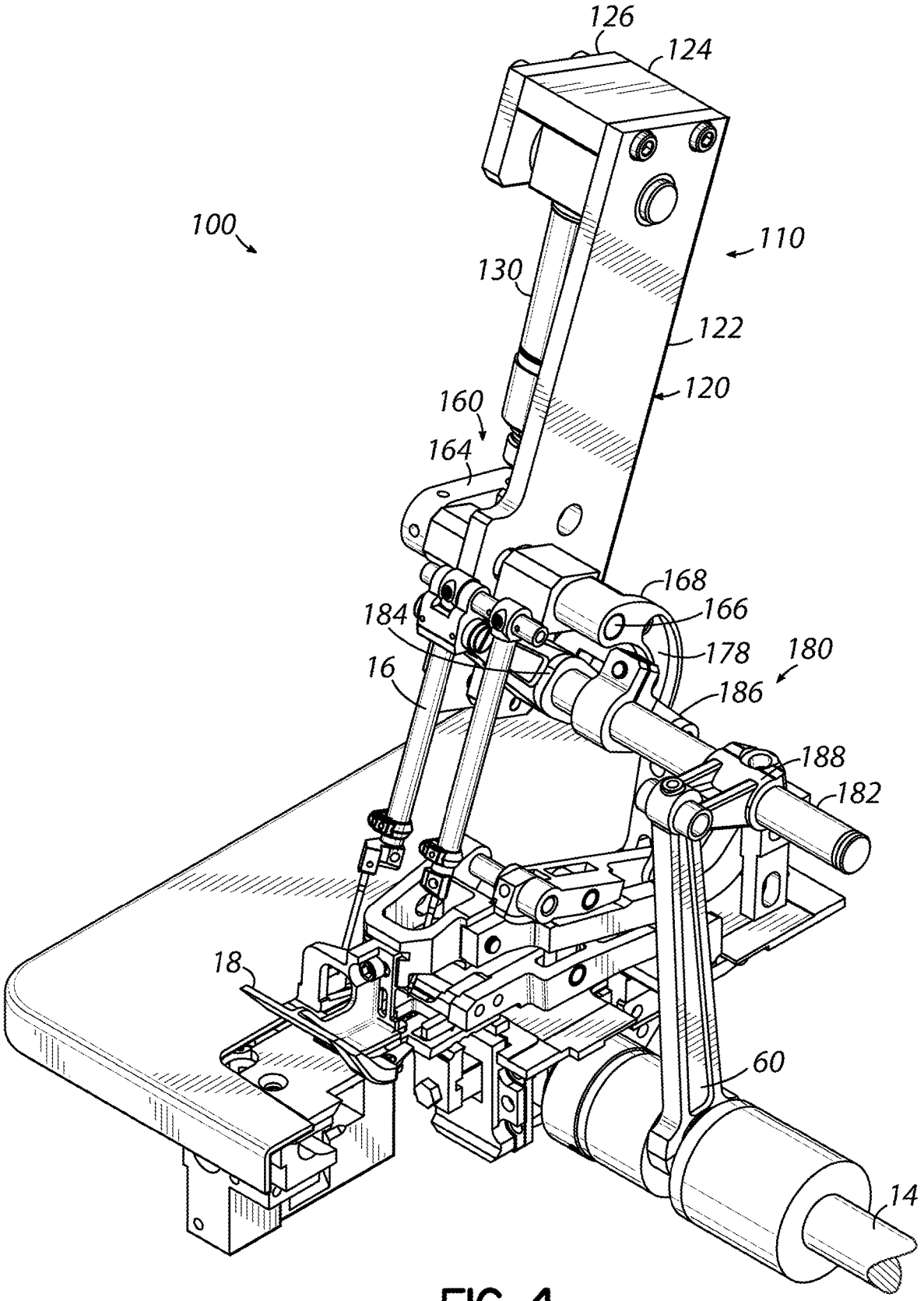
FIG. 4 is a detailed front, top, right perspective view of the sewing machine mechanism of FIGS. 2 and 3 with a needle housing not shown.
Figure 5:
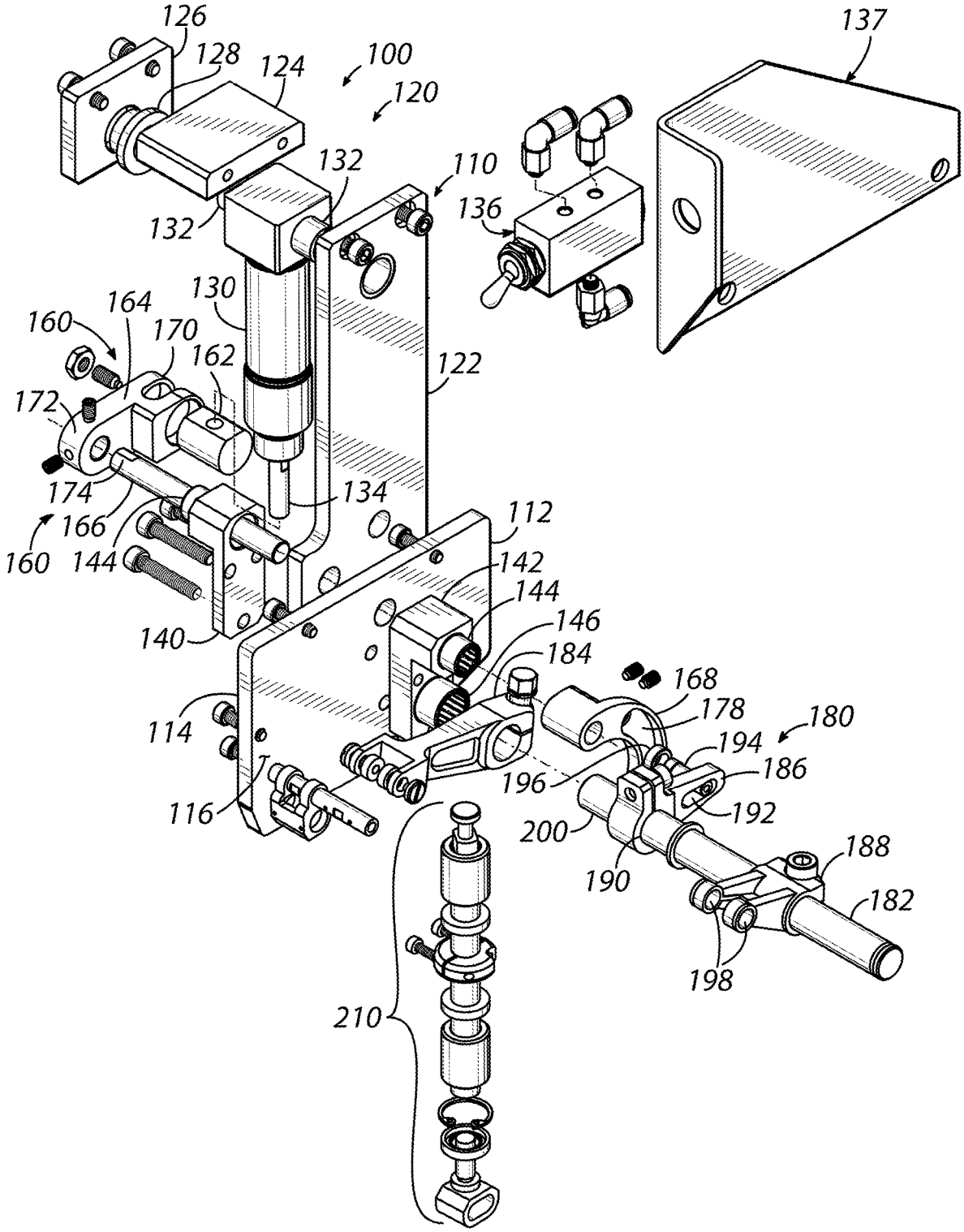
FIG. 5 is an exploded view of an illustrative stepping height adjustment mechanism of the sewing machine mechanism illustrated in FIGS. 2 through 4.

Referring to FIGS. 2 through 4, in this illustrative embodiment, an automated upper walking foot stepping height adjustment is added to an existing sewing machine 10. The mounting assembly 110, including the cover 112 and the actuator bracket 120, is mounted to the sewing machine 10. The cover 112 replaces an existing cover on the sewing machine 10. The mounting assembly 110 may be a complete assembly or may be assembled from its components as the mounting assembly 120 is installed on the sewing machine 10. The actuator 130 is coupled to the actuator bracket 120. The drive assembly 160 including the pivot 162, the drive arm 164, the drive shaft 166, and the guide 168 are mounted to the sewing machine 10. The actuator shaft 134 is coupled to the drive assembly 160. The actuator shaft 134 is coupled to the pivot 162 and the pivot 162 is coupled to the drive arm 164. The drive arm 164 is coupled to the drive shaft 166. The drive shaft 166 is installed through the mounting assembly 110. The guide 168 is coupled to the drive shaft 166. The drive assembly 160 may be a complete assembly or may be assembled from its components as the drive assembly 160 is installed on the sewing machine 10. The needle drive assembly 180 including the needle drive shaft 182, the needle drive lever 184, the variable drive crank 186, and the needle drive crank 188 are mounted to the sewing machine 10. The needle drive lever 184 is coupled to the needle drive shaft 182 and the needle assembly 16. The variable drive crank 186 is coupled to the needle drive shaft 182. The variable drive crank 186 is coupled to the guide 168 and the link 44 with the pin 194 and the wear disc 196. The needle drive crank 188 is coupled to the needle drive shaft 182 and the needle drive crank 188 is coupled to the crank arm 60. The needle drive assembly 180 may be a complete assembly or may be assembled from its components as the needle drive assembly 180 is installed on the sewing machine 10. At the same time an automated upper walking foot stepping height adjustment is installed on a sewing machine 10, other components may also be replaced thereby saving labor costs. For example, a walking foot linkage 210 may be included with the variable drive assembly 100 to replace a worn walking foot linkage 210, a known high wear assembly.

Referring to FIGS. 2 through 5, an illustrative method of manufacturing an assembly for adding an automated upper walking foot stepping height adjustment to a sewing machine includes providing the mounting assembly 110, the actuator 130, the drive assembly 160, and the needle drive assembly 180. The mounting assembly 110, the actuator 130, the drive assembly 160, and the needle drive assembly 180 may be sub-assemblies and/or individual components. The mounting assembly 110 includes the cover 112 and the actuator bracket 120. The actuator 130 includes an extending and retracting shaft 134. The drive assembly 160 includes the pivot 162, drive arm 164, the drive shaft 166, and the guide 168. The needle drive assembly 180 includes the needle drive shaft 182, the needle drive lever 184, the variable drive crank 186, and the needle drive crank 188. The method also includes supplying the pin 194 and the wear disc 196 for coupling the guide 168, the variable drive crank 186, and the link 44. The method may also include supplying the walking foot linkage 210.

Referring to FIGS. 2 through 5, and 9, an illustrative method of manufacturing a sewing machine 10 with an automated upper walking foot stepping height adjustment includes assembling the upper walking foot 20, the mounting assembly 110, the actuator 130, the drive assembly 160, and the needle drive assembly 180. The mounting assembly 110 includes the cover 112 and the actuator bracket 120. The actuator 130 includes an extending and retracting shaft 134. The actuator 130 is coupled to the actuator bracket 120. The drive assembly 160 includes the pivot 162, the drive arm 164, the drive shaft 166, and the guide 168. The pivot 162 is coupled to the actuator shaft 134 and the drive arm 164. The drive arm 164 is coupled to the drive shaft 166. The guide 168 is coupled to the drive shaft 166. The needle drive assembly 180 includes the needle drive shaft 182, the needle drive lever 184, the variable drive crank 186, and the needle drive crank 188. The needle drive lever 184 is coupled to the needle drive shaft 182. The variable drive crank 186 is coupled to the needle drive shaft 182. The needle drive crank 188 is coupled to the needle drive shaft 182. The method includes providing a pin 194 and wear disc 196. The pin 194 moves within the elongated slot 192 of the variable drive crank 186 and the wear disc 196 follows the groove 178 of the guide 168. Additionally, the pin 194 couples the needle drive assembly 180 to the link 44. The method includes providing a presser foot 18. The method includes providing a needle assembly 16.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination within and between the various embodiments. Additional advantages and modifications will be readily apparent to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A kit for adding or replacing an automated upper walking foot stepping height adjustment to a sewing machine, the kit comprising:
a mounting assembly including:
an actuator bracket;
an actuator coupled to the actuator bracket and including:
an actuator shaft that extends and retracts;
a drive assembly including:
a drive shaft,
a drive arm coupled to the drive shaft and the actuator shaft, and
a guide coupled to the drive shaft; and
a needle drive assembly including:
a needle drive shaft configured to replace a needle drive shaft of the sewing machine,
a variable drive crank coupled to the guide and the needle drive shaft, and
a needle drive lever coupled to the needle drive shaft and configured to drive a needle assembly of a sewing machine;
wherein selectively extending and retracting the actuator shaft selectively adjusts a stepping height of an upper walking foot.

2. The kit of claim 1 wherein selectively extending and retracting the actuator shaft sets an uppermost travel limit of a presser foot.

3. The kit of claim 1 wherein the mounting assembly further comprises a cover configured to replace an existing cover of the sewing machine; and
the actuator bracket is coupled to the cover.

4. The kit of claim 1 further comprising a control configured to be coupled to the actuator, and activation of the control permits selective extension and retraction of the actuator shaft.

5. A kit for adding or replacing an automated upper walking foot stepping height adjustment to a sewing machine, the kit comprising:
a mounting assembly including:
an actuator bracket;
an actuator coupled to the actuator bracket and including:
an actuator shaft that extends and retracts;
a drive assembly including:
a drive shaft,
a drive arm coupled to the drive shaft and the actuator shaft, and
a guide coupled to the drive shaft; and
a needle drive assembly including:
a needle drive shaft configured to replace a needle drive shaft of the sewing machine,
a variable drive crank coupled to the guide and the needle drive shaft, and
a needle drive crank coupled to the needle drive shaft and configured to couple to a crank arm of a sewing machine, and the crank arm drives the needle drive assembly;
wherein selectively extending and retracting the actuator shaft selectively adjusts a stepping height of an upper walking foot.

6. The kit of claim 5 wherein selectively extending and retracting the actuator shaft sets an uppermost travel limit of a presser foot.

7. The kit of claim 5 wherein the mounting assembly further comprises a cover configured to replace an existing cover of the sewing machine; and
the actuator bracket is coupled to the cover.

8. The kit of claim 5 further comprising a control configured to be coupled to the actuator, and activation of the control permits selective extension and retraction of the actuator shaft.

9. A kit for adding or replacing an automated upper walking foot stepping height adjustment to a sewing machine, the kit comprising:
a mounting assembly including:
an actuator bracket;
an actuator coupled to the actuator bracket and including:
an actuator shaft that extends and retracts;
a drive assembly including:
a drive shaft,
a drive arm coupled to the drive shaft and the actuator shaft, and
a guide coupled to the drive shaft;
a pin; and
a needle drive assembly including:
a variable drive crank coupled to the guide and configured to couple to a needle drive shaft of the sewing machine;
wherein selectively extending and retracting the actuator shaft selectively adjusts a stepping height of an upper walking foot, and
the variable drive crank includes an elongated slot and the pin is configured to move within the slot, and selectively extending and retracting the actuator shaft adjusts a position of the pin along a length of the slot.

10. The kit of claim 9 wherein selectively extending and retracting the actuator shaft sets an uppermost travel limit of a presser foot.

11. The kit of claim 9 wherein the needle drive assembly further comprises a needle drive shaft configured to replace the needle drive shaft of the sewing machine, and coupled to the variable drive crank.

12. The kit of claim 9 wherein the mounting assembly further comprises a cover configured to replace an existing cover of the sewing machine; and
the actuator bracket is coupled to the cover.

13. The kit of claim 9 further comprising a control configured to be coupled to the actuator, and activation of the control permits selective extension and retraction of the actuator shaft.

14. A sewing machine with an automated upper walking foot stepping height adjustment, the sewing machine comprising:
a mounting assembly including:
an actuator bracket;
an actuator coupled to the actuator bracket and including:
an actuator shaft that extends and retracts;
a drive assembly including:
a drive shaft,
a drive arm coupled to the drive shaft and coupled to the actuator shaft,
and
a guide coupled to the drive shaft; and
a needle drive assembly including:
a needle drive shaft,
a needle drive lever coupled to the needle drive shaft,
a variable drive crank coupled to the needle drive shaft and the guide, and
a needle drive crank coupled to the needle drive shaft;

an upper walking foot coupled to the variable drive crank; and a needle assembly coupled to the needle drive crank;

wherein selectively extending and retracting the actuator shaft adjusts a stepping height of the upper walking foot.

15. The sewing machine of claim 14 further comprising a presser foot coupled to the variable drive crank;

wherein selectively extending and retracting the actuator shaft sets an uppermost travel limit of the presser foot.

16. The sewing machine of claim 14 further comprising a control coupled to the actuator, and activation of the control permits selective extension and retraction of the actuator shaft.

17. The sewing machine of claim 14; wherein the sewing machine further comprises a pin; and the variable drive crank includes an elongated slot and the pin is configured to move within the slot, and selectively extending and retracting the actuator shaft adjusts a position of the pin along a length of the slot.

18. A method of adding or replacing an automated upper walking foot stepping height adjustment to a sewing machine, the method comprising:

installing a mounting assembly including an actuator bracket to a sewing machine;

coupling an actuator with an actuator shaft that extends and retracts to the actuator bracket;

coupling a drive arm to the actuator shaft;

coupling the drive arm to a drive shaft;

coupling a guide to the drive shaft; and coupling a variable drive crank to the guide and a needle drive shaft of the sewing machine;

wherein the variable drive crank includes an elongated slot; and the method further comprises coupling a pin to the guide and the pin is configured to move within the slot of the variable drive crank.

19. The method of claim 18 further comprising providing a needle drive shaft configured to replace the needle drive shaft of the sewing machine, and coupling the variable drive crank to the needle drive shaft.

20. The method of claim 18 further comprising coupling a presser foot to the variable drive crank.

21. The method of claim 18 further comprising coupling a stepping height control to the actuator.

22. A method of manufacturing a sewing machine with an automated upper walking foot stepping height adjustment, the method comprising:

installing a mounting assembly including an actuator bracket to a sewing machine;

coupling an actuator with an actuator shaft that extends and retracts to the actuator bracket;

coupling a drive arm to the actuator shaft;

coupling the drive arm to a drive shaft;

coupling a guide to the drive shaft;

coupling a variable drive crank to the guide and a needle drive shaft;

coupling a needle drive lever to the needle drive shaft;

coupling a needle assembly to the needle drive lever; and coupling an upper walking foot to the variable drive crank.

23. The method of claim 22 wherein the variable drive crank includes an elongated slot; and the method further comprises coupling a pin to the guide, and the pin is configured to move within the slot of the variable drive crank.

24. The method of claim 22 further comprising coupling a presser foot to the variable drive crank.

25. The method of claim 22 further comprising coupling a stepping height control to the actuator.

* * * * *